United States Patent [19]

Overton

[11] 4,309,369

[45] Jan. 5, 1982

[54] PROCESS AND APPARATUS FOR FORMING POURED CONCRETE WALLS

[76] Inventor: Richard M. Overton, Rte. #2, Box 209, Decatur, Mich. 49045

[21] Appl. No.: 102,896

[22] Filed: Dec. 12, 1979

[51] Int. Cl.[3] ..... E04B 1/16; E04G 11/08; E04G 17/10; B25B 9/00

[52] U.S. Cl. ..... 264/31; 249/41; 81/3 R

[58] Field of Search ..... 81/3 R; 225/93, 102, 225/103; 140/149, 123; 72/458, 459; 254/131; 249/41, 43, 45, 214, 216, 218; 264/35, 31

[56] References Cited

U.S. PATENT DOCUMENTS

| | | | |
|---|---|---|---|
| 1,463,077 | 7/1923 | Gandell | 81/90 F |
| 2,074,394 | 3/1937 | Hoffer | 249/214 |
| 2,887,758 | 5/1959 | Clark | 249/214 |
| 3,722,256 | 3/1973 | Iascone | 140/123 |

*Primary Examiner*—Roscoe V. Parker
*Attorney, Agent, or Firm*—Gordon W. Hueschen

[57] ABSTRACT

Apparatus and process for forming or casting poured concrete walls involve form sections, tie bars for tying the form sections together in spaced-apart relation, which tie bars have opposed notches or cut-ins in opposite edges of the tie bars, or like areas or zones of weakness, so located that they are coincident with the interface between the form and the concrete therein, and a device which is adapted to fit over the end portions of the tie bars which are exposed when the form sections have been removed and which is adapted to apply force to the exposed end portion in the plane of the tie bar, one vector of which is applied to one narrow edge of the exposed end portion adjacent the zone of weakness and another like vector of which is applied in the opposite direction to the opposite narrow edge of the exposed end portion at a point remote from the zone of weakness and adjacent or near the free end of the exposed end portion. The device comprises a rigid member having a middle elongate portion, a handle at one end, and a receptor at the other end for receiving the exposed end portion of the tie bar and applying force to the exposed end portion as described when the handle is grasped and pressure is applied thereto to impart a torque thereto in the plane of the tie bar so that when sufficient torque is engendered, the exposed end portion is snapped off at the face of the wall.

10 Claims, 7 Drawing Figures

PROCESS AND APPARATUS FOR FORMING POURED CONCRETE WALLS

FIELD OF INVENTION AND PRIOR ART

This invention relates to process and apparatus used in forming or casting poured concrete walls and is particularly directed to a combination for this purpose including form sections, tie bars for tying the form sections together to form a form, and special means for snapping off the exposed ends of the tie bars; to a form as a sub-combination thereof; to a device of breaking off the exposed end portions as a sub-combination; and to a process for forming the poured walls and breaking off the exposed end portions of the tie bars.

Poured concrete walls are commonly made using forms composed of form sections tied together in spaced-apart relation by tie bars. When the forms are removed from the set concrete, the ends of the tie bars extend beyond the poured wall and must be broken off one way or another. Sometimes tie rods are used and the rods with or without zones of weakness are twisted off. Also, at other times, flat tie bars are used which are twisted off with or without zones of weakness. In the latter case the zones of weakness, which may be opposed notches in narrow edges of the tie bar, are either embedded in the concrete wall or inset by means of special plugs on the tie bar. An example of such construction is found in U.S. Pat. No. 1,597,424, issued Aug. 24, 1926, where the exposed ends are twisted off by special twisting tool. In such cases a special inset is required and the hole left must be plugged up with a plug or with concrete. Similar constructions are found in U.S. Pat. Nos. 3,186,677, issued June 1, 1965; 3,625,470, issued Dec. 7, 1971; and 3,643,909, issued Feb. 22, 1972. These assemblies, however require either a special tie bar or a special inset thereon to provide a hole in the concrete so that the tie bar can be broken off beneath the surface of the wall. These assemblies also have the disadvantage that the hole left by the inset must be plugged up, also the added cost due to the insets.

An effort was made in U.S. Pat. No. 2,074,394, issued Mar. 23, 1937, to provide a flat tie bar which could be broken off inside the concrete wall without the need for the insets. A tie bar of special configuration and a wrench of special design are required so that a wedge action could be given to the tie bar so as literally to pull the exposed end away from the tie bar at a zone of weakness embedded in the concrete.

OBJECTS OF THE INVENTION

It is an object of the invention to provide an improved assembly for casting poured concrete walls. It is a further object of the invention to provide an improved process for casting poured concrete walls. It is a further object of the invention to provide an improved form making it possible to break the exposed portion of the tie rod off at the face of the concrete wall. It is a further object of the invention to provide an improved device for breaking off the exposed end portions of the tie bars. Further objects of the invention are to avoid the disadvantages of the prior art and to obtain advantages as will appear as the description proceeds.

BRIEF DESCRIPTION OF THE INVENTION

The invention relates to an apparatus for forming a poured concrete wall which comprises form sections;

flat tie bars; tie means for fastening the form sections together in spaced-apart relation by the tie bars, the tie bars having zones of weakness so located relative to the tie means that the zones of weakness coincide with the inner face of the form, whereby, when the form is removed from poured and set concrete, ends of the tie bars project outwardly from the face of the concrete and the zones of weakness coincide with the face thereof; and, a device for breaking off the exposed end portions of the tie bars comprising torque-applying means for applying a force to one narrow edge of an exposed end portion of the tie bar adjacent the zone of weakness and concomitantly applying a like force in the opposite direction to the opposite narrow edge in a position remote from the zone of weakness, the torque-applying means being operative to apply the forces in the plane of the tie bar to which the forces are applied, whereby, when sufficient force is thus applied, the exposed end is snapped off.

Advantageously, the torque-applying means comprises a rigid member having an elongate middle portion, a gripping portion at one end, and a receptor portion at the other end, which receptor portion comprises a receiver conforming closely to the narrow edges of the exposed end portion, at least adjacent the extremities thereof, and operating when force is applied to the gripping portion in the plane of the tie bar, to transfer the force to and concentrate it in the zone of weakness, whereby, when sufficient force is applied to the gripping means, the exposed end portion will be snapped off at the zone of weakness and at the face of the wall.

Advantageously, the receiver comprises a flat open-ended channel in the receptor portion with the sides thereof aligned with the elongate middle portion, which channel has a depth conforming with the narrow edges of the exposed end portion of the tie bar, a width conforming to the flat sides thereof, and a length sufficient to receive at least substantially all of the exposed end portion. Desirably, the channel has bridging means effective to hold the exposed end portion therein. Preferably, the bridging means covers only a portion of the channel adjacent the free end so that when the broken off end portion is in the channel, the end thereof is exposed and accessible to a pry in case the end portion should become wedged in the channel.

The invention is also directed to a process for forming a poured concrete wall and for breaking off an exposed end portion of a flat tie bar of the character described which comprises assembling a form with the tie bars holding form sections in spaced-apart relation with the zones of weakness of each tie bar coincident with the inner surfaces of the form, pouring concrete into the form and allowing it to set up therein, removing the form sections leaving the end portions of the tie bar exposed, grasping an exposed end portion along the opposite narrow edges thereof with a force-applying means adapted to apply a torque to the end portion in the plane of the tie bar, applying the torque thereto by applying a force to one narrow edge of the end portion adjacent the zone of weakness in the plane of the tie bar and concomitantly applying a like force in the opposite direction to the other narrow edge of the end portion remote from the zone of weakness and preferably near the extremity of the end portion, whereby, when sufficient force is applied the exposed end portion will be snapped off at the zone of weakness and at the face of the poured wall.

Advantageously, the force applying means in the above process comprises a rigid member having an elongate middle portion, a gripping portion at one end and a receptor portion at the other end adapted to receive the exposed end portion and to apply a force to one narrow edge of the end portion in one direction in the plane of the tie bar and a like force to the opposite narrow edge of the tie bar in the opposite direction when torque is applied to the exposed end portion by applying pressure to the gripping portion, grasping the gripping portion by hand and applying force thereto in the direction that will cause the forces to be applied to the exposed end portion in the manner specified above and sufficient to cause the exposed end portion to be snapped off.

The invention also is directed to a sub-combination in which the zone of weakness in the flat tie bar is located at the interface between the form and the concrete therein so that when the form sections are removed, the exposed ends of the tie bars can be snapped off by applying a force to one narrow edge adjacent the zone of weakness in the plane of the tie bar and concomitantly applying a like force to the opposite narrow edge at a point remote from the zone of weakness.

DETAILED DESCRIPTION OF THE INVENTION

Figures 1, 2, 3, 4, 5, 6, 7:
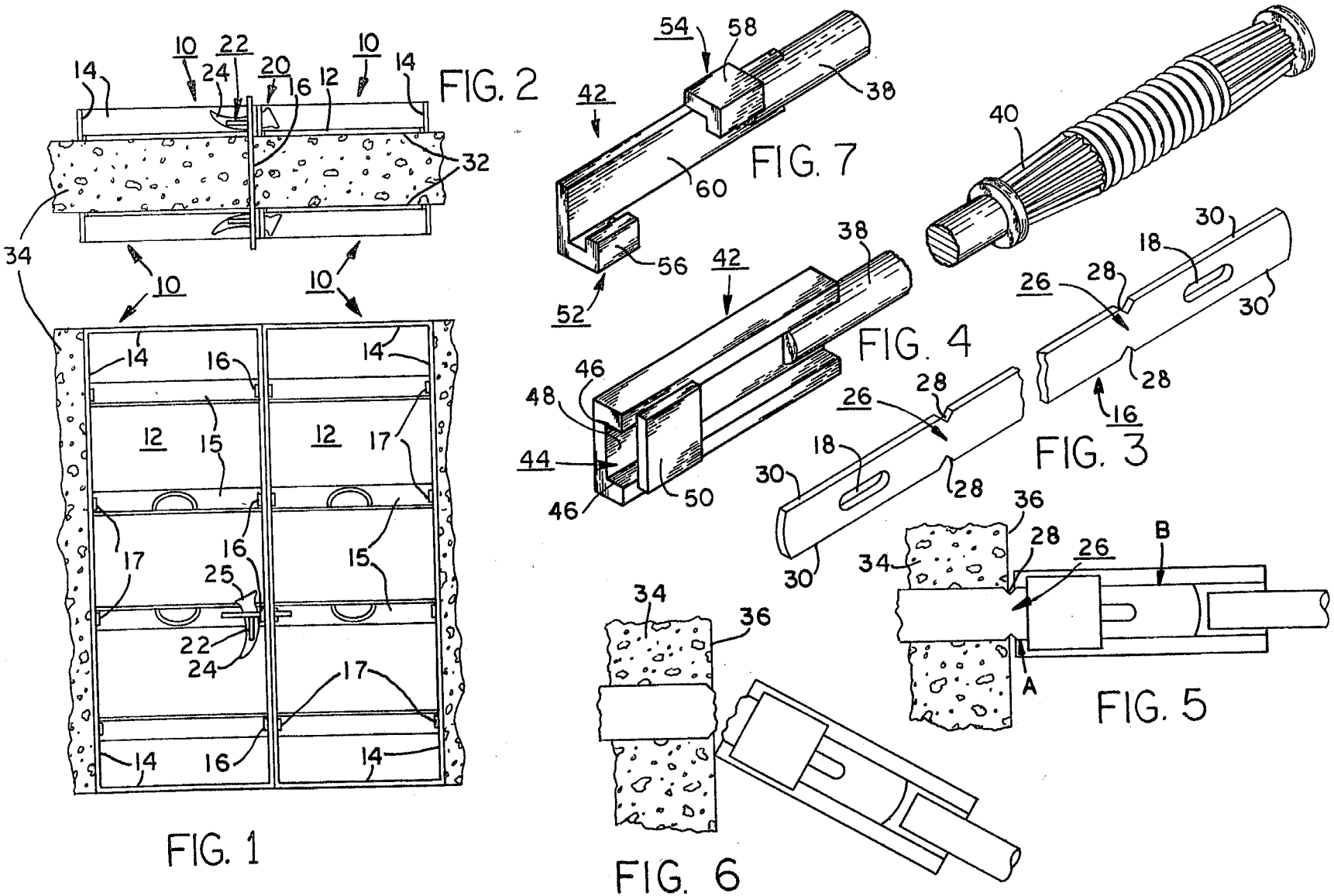
FIG. 1 is a side elevation showing two (2) form sections against the poured concrete walls.
FIG. 2 is a cross-section of FIG. 1 showing two (2) more form sections opposed to the first two (2).
FIG. 3 is an isometric of a flat tie bar of the invention.
FIG. 4 is an isometric of the device for breaking off an exposed end portion of the tie bar.
FIG. 5 is a side elevation in cross-section showing the tie bar embedded in the poured concrete wall and the exposed end portion thereof seated in the device of FIG. 4.
FIG. 6 is a side elevation showing how the exposed end portion is snapped off by the torque engendered by applying a force to the device of FIG. 4 in the plane of the tie bar.
FIG. 7 is the modified form of the device of FIG. 4.

In FIGS. 1 and 2, 10 designates form sections, each of which has a front rectangular panel 12, longitudinal and transverse upstanding sides 14 around the periphery thereof, and transverse reinforcement 15. The panels 12 are held together in spaced-apart relation, as shown in FIG. 2, by tie bars 16, which extend through slots 17 in panel 12 spaced along and adjacent to the upstanding long sides 14. The tie bars 16 have elongate slots 18 in the end portions thereof which, together with the wedges 20, function as tie means to tie the form sections together.

Each wedge 20 has a slot 22 intermediate the point 24 and the head 25. The upstanding long walls 14 have slots therein which are normal to the panels 12 and are long enough and wide enough to receive a wedge 20, as shown in FIG. 2. The wedge goes through opposed slots in juxtaposed upstanding walls 14 and through the elongate slot 18 in the tie bar, thus tying the form-forming sections 10 together in spaced-apart relation, as already known in the art.

A second wedge 20 is inserted in the slot 22 of the first wedge and driven in to the position shown in FIG. 1, thus tying the form sections 10 together as shown in FIG. 1.

The tie bar 16 has the zones of weakness 26 formed by the opposed notches 28 formed in the narrow edges 30 of the tie bar. These zones of weakness are located relative to the tie means for tying the form sections together so that the zone of weakness is at the interfaces 32 between the form and the poured concrete 34, thus, when the form sections are removed, the notches 28 coincide with the face 36 of the poured wall 34 as shown in FIG. 5.

The device for breaking off the exposed ends of the tie bars, as shown in FIG. 4, is made up of a rigid member having an elongate middle section 38, a gripping portion or handle 40 at one end and a receptor portion 42 at the other end. The receptor portion has a flat shallow channel 44, the sides 46 and 48 of which conformed to the narrow edges 30 of the exposed end portion of the tie bar and the bottom thereof conforms to the width thereof. The channel 44 is in alignment with the elongate middle portion 38 which in turn is in the alignment with the gripping portion 40.

Desirably, but not necessarily, a bridge 50 is welded across the channel 44 adjacent the end thereof. The purpose of this bridge is to keep the receptor 42 from sliding off of the exposed end of the tie bar. Advantageously the bridge 50 does not extend the full length of the channel of that the exposed end of the tie bar, as shown in FIGS. 5 and 6, is exposed so that a pry can be inserted therein to remove it in case it should have become jammed in the channel.

When the device of FIG. 4 is placed on the exposed end of the tie bar as shown in FIG. 5 and pressure is applied to the gripping means of 40 in the plane of the tie bar, as shown, the tie bar being in a vertical position and the plane therefore being vertical, by pushing it downward, a force A is applied upwardly to the bottom edge of the exposed portion of the tie bar adjacent to the zone of weakness 36 and a like force B is applied at a point remote from the zone of weakness for example, adjacent the extremity of the exposed portion as shown in FIG. 5. Thus a torque is applied to the exposed portion of the tie bar in the plane thereof such that, when the downward pressure on the gripping means 40 is great enough, the exposed end portion of the tie bar is snapped off, as shown in FIG. 6. In practice, a sharp downward thrust is all that is necessary to snap the exposed portion off.

In the modification shown in FIG. 6 the receptor 42 comprises a hook-shaped member 52 at the free end of the receptor and a complementary hook-shaped member 54 at the other end of the receptor but inverted relative to the hook-shaped member 52. In operation of this form of the invention a hook-shaped member 52 is hooked under the exposed end portion of the tie bar with the elongate member upward at an angle sufficient so that the hook-shaped member 54 can pass over the free end of the exposed end portion and hook-shaped member 54 can be brought into engagement therewith. Then a downward thrust on the gripping means 40 effects the same kind of torque as in the case of FIG. 5 and FIG. 6 and snaps off the exposed end portion of the tie bar.

The hook-shaped member 52 and 54 comprises L-shape members 56 and 58 welded to, or formed as an integral part of, a flat plate 60 which in turn is welded to, or formed as an integral part of, the elongate middle portion 38.

It is to be understood that the invention is not to be limited to the exact details of operation of structure shown and described, as obvious modifications and equivalents will be apparent to one skilled in the art.

I claim:

1. In a process for forming a poured concrete wall and for breaking off an exposed end portion of a flat tie bar which is used, along with other like bars, to tie together form sections used to assemble a form for a poured concrete wall, which tie bar has a narrow transverse zone of weakness at the inner end of said exposed end portion, which zone of weakness is so located with reference to means for fastening said tie bar to said form sections that said zone of weakness coincides with the interface between said form and the concrete poured therein, whereby, when the form sections are removed from the set poured wall, said zone of weakness is coincident with the face of said wall, the improvement making it possible effectively to use tie bars without lateral reinforcement, which comprises: assembling said form with said tie bars holding the form sections in spaced-apart relation with the zone of weakness of each tie bar coincident with the inner surfaces of the form, pouring concrete into said form and allowing it to set up therein, removing said form sections leaving said end portions exposed, said end portions being without lateral reinforcement, grasping an exposed said end portion along the opposite narrow edges thereof with a force-applying means adapted to apply equal and opposite forces to the opposite narrow edges of said end portion in the plane of said tie bar, one of said forces being applied to one narrow edge of said end portion adjacent to said zone of weakness in the plane of said tie bar and the other being applied concomitantly in the opposite direction to the other narrow edge of the said end portion at a point remote from said zone of weakness, whereby, said exposed end portion is placed under a torque which, when sufficient force is applied, will cause the exposed end portion to be snapped off at the zone of weakness and at the face of the poured wall, all of said force being applied in the plane of said tie bar, whereby lateral bending does not occur, so that the tie bar does not need to be reinforced against lateral bending.

2. A process of claim 1, in which said force-applying means comprises a rigid member having an elongate middle portion, a gripping portion at one end, and a receptor portion at the other end adapted to receive said exposed end portion and to apply said first-named force to one narrow edge of said end portion in one direction in the plane of said tie bar and said second-named force to the opposite narrow edge of the tie bar in the opposite direction whereby torque is applied to said exposed end portion when pressure is applied to said gripping portion, grasping said gripping portion by hand, and applying force thereto in the direction that will cause said forces to be applied to said exposed end portion in the manner specified above and sufficient to cause said exposed end portion to be snapped off.

3. In apparatus for forming a poured concrete wall which comprises: form sections; flat tie bars; and tie means for fastening said form sections together in spaced-apart relation by said tie bars, said tie bars having zones of weakness so located relative to said tie means that said zones of weakness coincide with the inner face of said form, whereby, when the form is removed from poured and set concrete, ends of said tie bars project outwardly from the face of the concrete and the zones of weakness coincide with the face thereof; the combination therewith of a device for breaking off the exposed end portions of said tie bars comprising first engaging means for engaging and applying a force to one narrow edge of an exposed end portion of said tie bar adjacent the zone of weakness thereof and a second engaging means for concomitantly engaging and applying a like force in the opposite direction to the opposite narrow edge in a position remote from said zone of weakness, and torque-applying means operative to apply said forces in the plane of the tie bar to which the forces are applied, said torque-applying means comprising a rigid member having an elongate middle portion, a gripping portion at one end, and a receptor portion at the other end, which receptor portion comprises a receiver, having a flat surface conforming closely to a flat side of said exposed end portion, narrow edge portions conforming closely to the narrow edges of said exposed end portion, at least adjacent the extremities thereof, and holding means for holding said exposed end portion with a flat side thereof in flat surface to surface contact with said flat surface, said torque-applying means being operative, when force is applied to said gripping portion in the plane of said tie bar, to transfer said force to said exposed end portion through said first and second engaging means and to concentrate it in said zone of weakness, whereby, when sufficient said force is applied to said grasping portion, said exposed end portion will be snapped off at said zone of weakness at the face of said wall.

4. Apparatus of claim 1, in which said receiver comprises a flat open-ended channel having a flat bottom surface and parallel sides normal thereto, said channel being aligned with said elongate middle portion and having a depth conforming with the narrow edges of the exposed end portion of said tie bar, a width conforming to the flat sides of said exposed end portion, and a length sufficient to receive at least substantially all of said exposed end portion.

5. Apparatus of claim 4, in which said holding means comprises bridging means which extends from one side to the other, is parallel to said flat surfaces, and is effective to hold said end portion in said channel.

6. Apparatus of claim 5, in which said bridging means covers only a portion of said channel adjacent the free end thereof, whereby, when the broken off end portion is in said channel, the end thereof is exposed and accessible to a pry in case the end portion should become wedged in said channel.

7. A device for breaking off an exposed end portion of a flat tie bar which is used, along with other like bars, to tie together form sections used to assemble a form for a poured concrete wall, which tie bar has a narrow transverse zone of weakness at the inner end of said exposed end portion, which zone of weakness is so located with reference to means for fastening said tie bar to said form sections that said zone of weakness coincides with the interface between said form and the concrete poured therein, whereby, when the form sections are removed from the set poured wall, said zone of weakness is coincident with the face of said wall, which device comprises: a rigid member having an elongate middle portion, a gripping portion at one end, and a receptor portion at the other end, which receptor portion comprises a receiver, having a flat surface conforming closely to a flat side of said exposed end portion, narrow edge portions conforming closely to the narrow edges of said exposed end portion, at least adjacent the extremities thereof, and holding means for holding said exposed end portion with a flat side thereof in flat surface to surface contact with said flat surface, said torque-applying means being operative, when force is applied to said gripping portion in the plane of said tie bar, to transfer one vector of said force to one edge of said exposed end portion adjacent to the zone of weakness and another vector of said force to the opposite narrow edge of said exposed end portion at a point remote from said zone of weakness, thereby to apply a torque to said exposed end portion in the plane thereof whereby, when sufficient said force is applied to said gripping portion, said exposed end portion will be snapped off at said zone of weakness and at the face of said wall.

8. The device of claim 7, in which said receiver comprises a flat open-ended channel having a flat bottom surface and parallel sides normal thereto, said channel being aligned with said elongate middle portion and having a depth conforming with the narrow edges of the exposed end portion of said tie bar, a width conforming to the flat sides of said exposed end portion, and a length sufficient to receive at least substantially all of said exposed end portion.

9. Apparatus of claim 8, in which said holding means comprises bridging means which extends from one side to the other, is parallel to said flat surfaces, and is effective to hold said end portion in said channel.

10. The device of claim 9, in which said bridging means covers only a portion of said channel adjacent the free end thereof, whereby, when the broken off end portion is in said channel, the end thereof is exposed and accessible to a pry in case the end portion should become wedged in said channel.

* * * * *

UNITED STATES PATENT AND TRADEMARK OFFICE

CERTIFICATE OF CORRECTION

PATENT NO. : 4,309,369

DATED : January 5, 1982

INVENTOR(S) : Richard M. Overton

It is certified that error appears in the above—identified patent and that said Letters Patent is hereby corrected as shown below:

Col. 6, line 30; "1" should read -- 3 --

Signed and Sealed this

*Seventeenth* Day of *August 1982*

[SEAL]

*Attest:*

GERALD J. MOSSINGHOFF

*Attesting Officer*

*Commissioner of Patents and Trademarks*